US007596813B2

(12) United States Patent
Borowski et al.

(10) Patent No.: US 7,596,813 B2
(45) Date of Patent: Oct. 6, 2009

(54) SAFETY JACKET

(76) Inventors: Robert J. Borowski, 1985 NE. 15th Ave., FT Lauderdale, FL (US) 33305; Cynthia Borowski, 1985 NE. 15th Ave., FT. Laud., FL (US) 33305

( * ) Notice: Subject to any disclaimer, the term of this patent is extended or adjusted under 35 U.S.C. 154(b) by 0 days.

(21) Appl. No.: 11/444,265

(22) Filed: May 31, 2006

(65) Prior Publication Data

US 2007/0277283 A1 Dec. 6, 2007

(51) Int. Cl.
*A41D 1/02* (2006.01)
*A41D 3/02* (2006.01)

(52) U.S. Cl. ..... 2/93; 2/94

(58) Field of Classification Search ..... 2/69, 2/94, 108, 93, 102, 336; 182/3; 224/674
See application file for complete search history.

(56) References Cited

U.S. PATENT DOCUMENTS 1,444,750 A * 2/1923 Moore ..... 2/94
3,973,643 A * 8/1976 Hutchinson ..... 182/3
4,051,554 A * 10/1977 Kallman ..... 2/94
4,106,121 A * 8/1978 Belson ..... 2/102
4,132,230 A * 1/1979 Ladd ..... 128/874
4,168,544 A * 9/1979 Kallman ..... 2/94
4,302,847 A * 12/1981 Miles ..... 2/465
4,608,716 A * 9/1986 Brumfield ..... 2/2.5
4,875,237 A * 10/1989 Cohen ..... 2/94
4,969,214 A * 11/1990 Cohen ..... 2/94
5,002,270 A * 3/1991 Shine ..... 482/105
5,036,548 A * 8/1991 Grilliot et al. ..... 2/81
5,176,600 A * 1/1993 Wilkinson ..... 482/124
5,247,707 A * 9/1993 Parker et al. ..... 2/102
5,402,539 A * 4/1995 Hewitt ..... 2/227
5,450,627 A * 9/1995 Grilliot et al. ..... 2/81
5,488,738 A * 2/1996 Seamans ..... 2/69
5,617,582 A * 4/1997 Burwell ..... 2/102
5,738,046 A 4/1998 Williams et al.
6,024,091 A * 2/2000 Bennett ..... 128/873
6,088,831 A 7/2000 Jensen et al.
6,122,778 A 9/2000 Cohen
6,128,782 A 10/2000 Young et al.
6,134,713 A * 10/2000 De Rosa et al. ..... 2/94
6,367,582 B1 * 4/2002 Derby ..... 182/3
6,473,905 B1 * 11/2002 Katz ..... 2/48
6,662,373 B2 12/2003 Frank
6,892,395 B2 * 5/2005 Schweer ..... 2/94
7,000,255 B1 * 2/2006 Baacke ..... 2/94
2003/0172431 A1 * 9/2003 Allen ..... 2/69
2003/0213043 A1 * 11/2003 Lewis et al. ..... 2/69
2004/0025216 A1 * 2/2004 Marogil ..... 2/69
2006/0236440 A1 * 10/2006 Zahler ..... 2/69
2007/0017001 A1 * 1/2007 Wagner et al. ..... 2/102
2007/0067889 A1 * 3/2007 Spiewak et al. ..... 2/69

* cited by examiner

*Primary Examiner*—Alissa L Hoey

(57) ABSTRACT

A jacket for use by public service personnel such as policemen or the like is shorter than a usual jacket so it will not cover the wearer's hip area when worn. Straps are located on the bottom end of the jacket and will accommodate or support a utility belt adjacent to the wearer's hip area but beneath the jacket so the jacket does not cover the utility belt. The utility belt is thus easily accessed without moving the jacket.

1 Claim, 1 Drawing Sheet

SAFETY JACKET

TECHNICAL FIELD OF THE INVENTION

The present invention relates to the general art of wearing apparel, and to the particular field of special article carrying body garments.

BACKGROUND OF THE INVENTION

A problem which is most common with peace officers is the necessity to wear heavy gear. Duty or utility belts are most commonly worn by peace officers. These belts are used to hold the necessary gear that a peace officer uses which typically include a firearm and holster, handcuffs in a handcuff case, an ammunition case, a baton, a flashlight, pepper spray, a knife a microphone and a police case radio. This equipment can collectively weigh between 8 and 13 pounds. The duty belt is held to the pants belt by keepers which pass under the pants belt and snap over the duty belt transferring the weight on the duty belt to the pants belt. This weight supported by a wearer's belt through the keepers can place a strain on the lower back and hips of the officer. Furthermore, the weight of such gear continuously pulls downwardly on the wearer's belt and can cause the duty belt to move downwardly from its preferred location. Still further, the belt must be worn beneath the jacket. In cold weather, the jacket my cover the belt, and require the wearer to lift the bottom of the jacket in order to gain access to the belt. This can be cumbersome and can interfere with the wearer completing his or her task.

Emergency medical personnel, firefighters, military personnel and rescue squad personnel also must carry a great deal of gear on their person. These personnel also are subject to the same problems as the above-discussed peace officers. For the purposes of this disclosure, all of the just-mentioned personnel will be referred to as public safety personnel.

Therefore, there is a need for a jacket that can be worn by public safety personnel which will permit that person to have convenient access to a utility belt at all times without interfering with the wearer carrying out his or her task. Furthermore, in addition to public safety worker, other workers, tradesmen, sportsmen, hobbyists and others must carry and retain tools or other supplies within easy reach to accomplish their various tasks. Ideally, a means for transporting tools and accessories should minimize strain on the user's back and over-heating, while enabling the user to use readily available tool and accessory pouches.

Tool belts have been used to carry tools and other items and a great many tool pouches and other accessory carriers have been adapted for attachment to them. Unfortunately however, tool belts generally create an uneven strain on the back of the user and are often bulky and uncomfortable to wear. So though using a tool belt may provide a user a wide selection of tool and accessory pouches, it is at a cost to the user's back, legs and general comfort.

Utility vests, by contrast, generally are more comfortable to wear and create less strain on the back and legs of a user. However, these do not provide the user with the wide selection of generic and readily available tool pouches available for use with tool belts, requiring instead that a user purchase pouches with specialized means of attachment to the vest.

Therefore, there is a need for a jacket or other such wearing apparel that will allow a wearer to have ready access to tools, supplies and the like associated with their job.

SUMMARY OF THE INVENTION

The above-discussed disadvantages of the prior art are overcome by a jacket that is shorter than a normal jacket and has utility-belt accommodating straps on the lower end thereof. A utility belt is accommodated in the straps and will be located outside of the jacket so the wearer can easily gain access to the utility belt without moving the jacket. The jacket need not be bunched up to gain access to the utility belt so the jacket and the utility belt can be comfortably and stylishly worn together without either item interfering with the other.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 2:
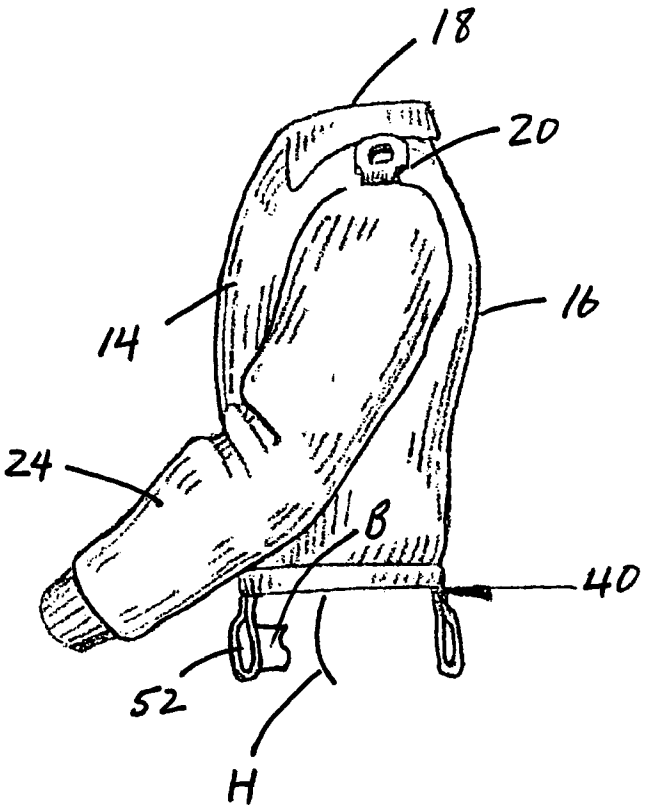
FIG. 2 is a side elevational view of the jacket shown in FIG. 1.
Figure 1:
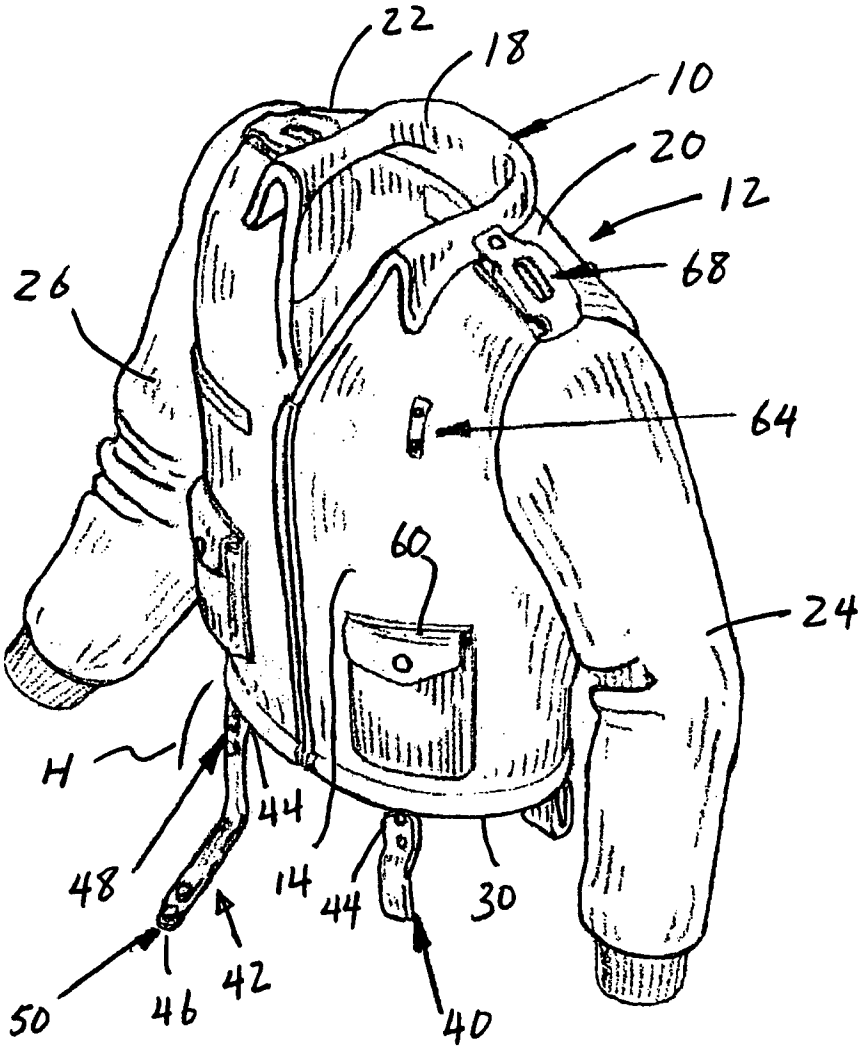
FIG. 1 is a front perspective view of an article carrying jacket embodying the present invention.

Referring to the figures, it can be understood that the present invention is embodied in an article carrying jacket 10 for use by public safety personnel. Jacket 10 comprises a torso-covering portion 12 which has a first section 14 which is a front section when the torso-covering portion is worn, a second section 16 that is a rear section when the torso-covering portion is worn, a neck-accommodating section 18, two shoulder sections 20 and 22 adjacent to the neck section and two sleeve sections 24 and 26 that are identical to each other and that are attached to the torso-covering portion adjacent to the shoulder sections.

A second end 30 is a lower end when the torso-covering portion is worn and is located adjacent to and spaced above a wearer's waist/hip area H when the torso-covering portion is worn. A plurality of identical straps, such as straps 40 and 42, are mounted on the torso-covering portion at second end 30. Each strap includes a first end 44 fixed to second end 30 of the torso-covering portion and a second end 46.

A snap closure 48 is located on the first end and a snap closure 50 is located on the second end. The snap closures cooperate with each other to releasably connect second end 46 to first end 44 to define a loop 52 which is located subadjacent to second end 30 of the torso-covering portion whereby a utility belt B mounted in the straps will be located near the wearer's waist/hip area H when the torso-covering portion is worn.

A plurality of pockets, such as pocket 60, are located on the torso-covering portion. A badge-holder strap 64 is mounted on first surface 14 of the torso-covering portion. Two equipment-mounting straps, such as strap 68, are mounted on the shoulder sections of the torso-covering portion. Microphones or the like can be mounted on the jacket in the straps 68.

When a user wears jacket 10, a utility belt will be located in a proper area on his or her hips and the jacket need not be pulled up to gain access to that utility belt nor does the jacket have to be bunched up to accommodate the utility belt. The jacket can be comfortably and stylishly worn with a utility belt located in a proper position on the wearer. Jacket 10 is shorter, as measured between the shoulder sections and the lower end 30 than other jackets so the utility belt accommodating straps will be located adjacent to the wearer's hips outside the jacket when the jacket is worn as opposed to a usual jacket which comes over the wearer's hip area and thus will cover a utility belt.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. An article carrying jacket for use by safety personnel comprising:

a torso-covering portion having a first section that is a front section when the torso-covering portion is worn, a second section that is a rear section when the torso-covering portion is worn, a neck-accommodating section, two shoulder sections adjacent to the neck section, two sleeve sections attached to the torso covering portion adjacent to the shoulder sections and a bottom edge;

the bottom edge of the torso-covering portion located adjacent to and spaced above a wearer's waist/hip area when the torso-covering portion is worn;

a plurality of straps are mounted to the bottom edge of the torso-covering portion along the front section and;

a plurality of straps are mounted to the bottom edge of the torso-covering portion along the rear section;

the plurality of straps extend below the bottom edge of the torso covering portion; each strap including: a first end fixed to the bottom edge of the torso-covering portion, a second end and a snap closure on the first end of the strap and on the second end of the strap for releasably connecting the second end of the strap to the first end of the strap to define a loop which is located below the bottom edge of the torso-covering portion;

whereby a utility belt mounted in the plurality of straps will be located at the wearer's waist-hip area below the bottom edge of the torso-covering portion;

a plurality of pockets on the front section of the torso-covering portion;

a badge-holder strap mounted on the front section of the torso-covering portion; and two equipment-mounting straps mounted on the shoulder section of the torso-covering portion.

* * * * *